US008715898B2

(12) United States Patent
Yanagida

(10) Patent No.: US 8,715,898 B2
(45) Date of Patent: May 6, 2014

(54) ELECTROSTATIC CHARGE IMAGE DEVELOPER, PROCESS CARTRIDGE, IMAGE FORMING APPARATUS, AND IMAGE FORMING METHOD

(75) Inventor: Kazuhiko Yanagida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/534,637

(22) Filed: Jun. 27, 2012

(65) Prior Publication Data

US 2013/0252166 A1 Sep. 26, 2013

(30) Foreign Application Priority Data

Mar. 26, 2012 (JP) ..... 2012-069954

(51) Int. Cl.
*G03G 9/00* (2006.01)
*G03G 5/00* (2006.01)

(52) U.S. Cl.
USPC ..... 430/109.4; 430/111.4; 430/118.6; 430/123.51; 399/259

(58) Field of Classification Search
USPC ..... 430/109.4, 111.4, 118.6, 123.51; 399/259
See application file for complete search history.

(56) References Cited

U.S. PATENT DOCUMENTS

| | | | | |
|---|---|---|---|---|
| 2009/0081573 | A1* | 3/2009 | Iwazaki et al. | 430/108.7 |
| 2009/0103950 | A1* | 4/2009 | Nakayama et al. | 399/252 |
| 2011/0097662 | A1* | 4/2011 | Vanbesien et al. | 430/111.31 |

FOREIGN PATENT DOCUMENTS

| | | |
|---|---|---|
| JP | A-08-020636 | 1/1996 |
| JP | A-10-239903 | 9/1998 |
| JP | A-11-133668 | 5/1999 |
| JP | A-2009-156902 | 7/2009 |

* cited by examiner

*Primary Examiner* — Thorl Chea
(74) *Attorney, Agent, or Firm* — Oliff PLC

(57) ABSTRACT

An electrostatic charge image developer includes a toner for developing an electrostatic charge image, containing toner particles including a polyester resin having a rosin skeleton and an external additive, and a carrier having core material particles and a coating resin layer which coats the surface of the core material particles, in which the hardness of the coating resin layer is from 1.2 times to 2.0 times that of the toner particles.

5 Claims, 2 Drawing Sheets

ELECTROSTATIC CHARGE IMAGE DEVELOPER, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-069954 filed Mar. 26, 2012.

BACKGROUND

Technical Field

The present invention relates to an electrostatic charge image developer, a process cartridge, an image forming apparatus, and an image forming method.

SUMMARY

According to an aspect of the invention, there is provided an electrostatic charge image developer including a toner for developing an electrostatic charge image containing toner particles including a polyester resin having a rosin skeleton and an external additive, and a carrier having core material particles and a coating resin layer which coats the surface of the core material particles, in which the hardness of the coating resin layer is from 1.2 times to 2.0 times that of the toner particles.

BRIEF DESCRIPTION OF THE DRAWINGS

Exemplary embodiments of the present invention will be described in detail based on the following figures, wherein.

DETAILED DESCRIPTION

Figure 1:
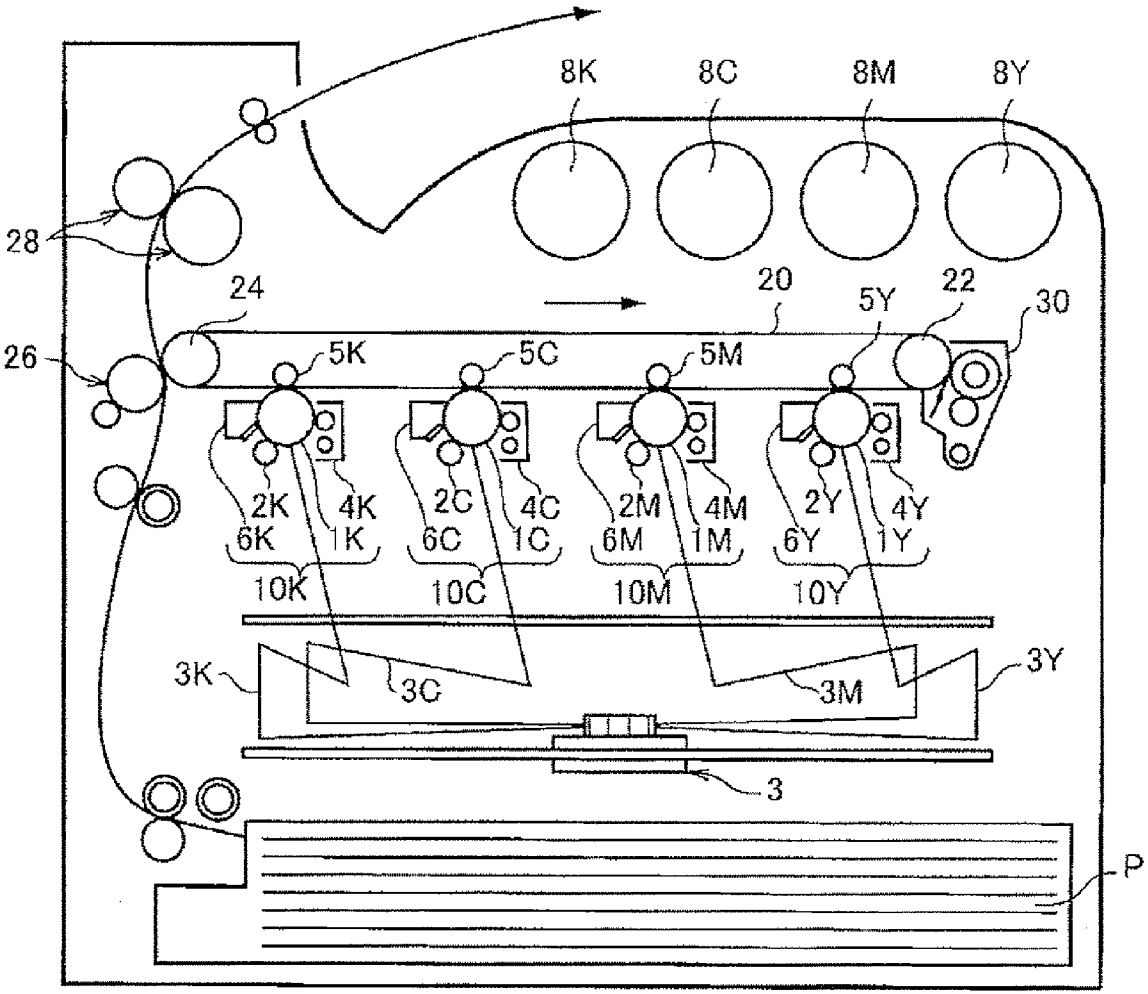
FIG. 1 is a schematic configuration diagram showing an example of the image forming apparatus according to the present exemplary embodiment.

Hereinbelow, an exemplary embodiment that is an example of the invention will be described in detail.

[Electrostatic Charge Image Developer]

The electrostatic charge image developer according to the present exemplary embodiment (which is hereinafter referred to as a "developer" in some cases) includes a toner for developing an electrostatic charge image (which is hereinafter referred to as a "toner" in some cases) which includes a toner containing toner particles including a polyester resin having a rosin skeleton (which is hereinafter referred to as a "specific polyester resin" in some cases) and an external additive, and a carrier having core material particles and a coating resin layer which coats the surface of the core material particles, in which the hardness of the coating resin layer is from 1.2 times to 2.0 times that of the toner particles.

Herein, the toner particles containing a specific polyester resin tends to have a higher hardness than the toner particles using a resin not having a rosin skeleton put thereinto, due to the properties that the rosin has.

Furthermore, such toner particles having a high hardness tend to have an external additive in the toner be not easily embedded therein.

That is, a developer including the toner containing the toner particles having a high hardness and an external additive suppresses the reduction in the charging amount of the toner due to the embedment of the external additive in the toner particles, and therefore, it is thought that when the developer is applied in formation of an image, generation of an image defect due to scattering of the toner or scumming (contamination of the non-image portion of a printed material) is suppressed.

On the other hand, it is thought that a developer including the toner as described above has a tendency that the external additive is not easily embedded in the toner particles, but is easily embedded in the coating resin layer of the carrier.

For this reason, when an image is formed using the developer including the toner as described above, the external additive is embedded in the coating resin layer of the carrier with vibration in the image formation, thus, the ability to provide the toner with charges in the carrier is decreased, and as a result, there is a tendency that the charging amount of the toner is decreased.

Therefore, when the developer according to the present exemplary embodiment has the configuration as described above, the reduction in the charging amount of the toner is suppressed.

The reason therefor is not clear, but is speculated as follows.

The developer according to the present exemplary embodiment includes a toner having toner particles having a high hardness and a carrier having a coating resin layer having a higher hardness than the toner particles.

Accordingly, for example, even in a case of performing an image forming step in which an impact is applied by TURBULA mixer that gives vibration or a regulating member that regulates the amount of a developer supplied to a developing sleeve, there is a tendency that the external additive is not easily embedded in either of the toner particles and the carrier.

For this reason, the reduction in the charging amount of the toner due to embedment of the external additive in the toner particles is suppressed, the external additive is embedded in the coating resin layer of the carrier, and thus, the ability of the carrier to provide charges is decreased, and as a result, the reduction in the charging amount of the toner is suppressed. Accordingly, with the developer according to the present exemplary embodiment, the reduction in the charging amount of the toner involved in the formation of an image from both sides of the toner and the carrier is suppressed.

As seen from above, with the developer according to the present exemplary embodiment, the reduction in the charging amount of the toner is suppressed.

Moreover, when the developer according to the present exemplary embodiment is used even in continuous image formation, the reduction in the charging amount of the toner is suppressed, and as a result, for example, generation of an image defect due to scattering of the toner or background fouling (contamination of a non-image portion of a printed material), due to reduction in the charging amount of the toner, is suppressed.

In addition, it is thought that when the developer according to the present exemplary embodiment is used even in continuous image formation, the reduction in the charging amount of the toner is suppressed, and as a result, the lifetime is increased.

Herein, the ratio of the hardness of the coating resin layer with respect to the hardness of the toner particles (hardness of the coating resin layer/hardness of the toner particles) is from 1.2 to 2, preferably from 1.5 to 1.85, and more preferably from 1.6 to 1.8.

When the ratio of the hardness of the coating resin layer with respect to the hardness of the toner particles is 1.2 or more, the embedment of the external additive in the coating resin layer of the carrier is suppressed, and thus, the reduction in the ability of the carrier to provide charges is suppressed.

Furthermore, when the ratio of the hardness of the coating resin layer with respect to the hardness of the toner particles is equal to or less than 2.5, the hardness of the coating resin layer of the carrier is remarkably increased, as compared with that of the toner particles, and thus, a phenomenon that the external additive is not easily embedded whereas the external additive is easily embedded only in the toner particles is suppressed, and as a result, the reduction in the charging amount of the toner is suppressed.

Moreover, the hardness of the coating resin layer is from 0.168 GPa to 0.28 GPa, preferably from 0.21 GPa to 0.259 GPa, and more preferably from 0.224 GPa to 0.252 GPa.

In addition, the hardness of the toner particles is from 0.1 GPa to 0.2 GPa, preferably from 0.12 GPa to 0.18 GPa, and more preferably from 0.14 GPa to 0.16 GPa.

The hardness of the toner particles and the hardness of the coating resin layer are determined by a method as described below.

The hardness of the coating resin layer is determined by measuring a resin layer for measurement that is prepared and obtained as follows.

First, a carrier is recovered from a developer, the coating resin layer on the carrier surface is dipped in a tetrahydrofuran solution, and the eluted resin layer and the settled core material particles are separated and detached from each other.

The coating resin layers thus detached are collected and used as samples.

Next, a base of 10 mm×10 mm that has been cut from a silicon wafer having a film thickness of 300 μm is placed on an aluminum plate, and a solution formed by dissolving the sample in a tetrahydrofuran solution is poured thereinto to a concentration of 10% by weight. The amount of the solution to be poured is determined so that the thickness of the resin layer on the base after evaporation of the solvent is from 30 μm to 40 μm. The solution is dried on the aluminum plate at normal temperature (for example, 25° C.), and then further dried at a temperature of 70° C. for 5 hours by a device having a heating function to obtain a resin layer for measurement having a thickness of from 30 μm to 40 μm.

The hardness of the toner particles is determined by measuring a tablet for measurement as prepared and obtained in the following manner.

First, the toner is recovered from the developer, dispersed in ion exchange water, subjected to irradiation with ultrasonic waves to separate the external additive and the toner particles, and then subjected to filtration and washing treatments, to recover only the toner particles.

The toner particles thus recovered are collected and subjected to a 60 KN load with a tableting machine having a diameter of 12 mm to obtain a tablet for measurement, measuring 8 mm in height and 12 mm in diameter.

For the resin layers for measurement and the tablets for measurement, the hardness is measured using a Nanoindenter (registered trademark, manufactured by MTS Systems Inc.).

Measurement is carried out at ten points in the same resin layers for measurement and the same tablets for measurement under the conditions of a maximum load ($P_{max}$): 0.8 [mN], an indenter used: diamond, a Berkovich type with triangular pyramid, and temperature: 23° C.

Specifically, in the case of the resin layer for measurement, for the surface of the resin layer for measurement on a silicon wafer, the hardness is measured at five points at an interval of 1 mm in a given direction from any position and further measured at five points at an interval of 1 mm in the direction perpendicular to the given direction, and in the case of the tablet for measurement, for its surface, the hardness is measured at five points at an interval of 1 mm in a given direction from any position, and similarly, for the back surface, the hardness is measured at five points.

The respective hardness values are determined using the following formula and averaged.

$$H[\mathrm{GPa}]=P_{max}[N]/A[\mathrm{mm}^2] \qquad \text{Formula}$$

wherein H represents a hardness, $P_{max}$ represents a maximum load, and A represents a projected cross-sectional area of a print to which an indenter is attached. The hardness may be obtained in two types of a dynamic hardness and a Shore load, but unless specified otherwise, a Shore hardness is used.

Hereinafter, the polyester resin for a toner according to the present exemplary embodiment will be described in detail.

<Toner for Developing Electrostatic Charge Image>

The toner for developing an electrostatic charge image includes toner particles containing a specific polyester resin and an external additive.

(Toner Particles)

The toner particles include a binder resin, and if necessary, a colorant, a release agent, and other additives.

Examples of the binder resin include an amorphous resin, and as the amorphous resin, the specific polyester resin as described above is also employed, but amorphous resins other than the specific polyester resin may also be used in combination therewith.

Furthermore, as the binder resin, a crystalline resin may be used in combination with an amorphous resin.

However, the content of the specific polyester resin is preferably 70 parts by weight or more, and more preferably 90 parts by weight or more, with respect to 100 parts by weight of all the binder resins.

Moreover, the amorphous resin refers to a resin having no definite endothermic peak but having only a stepwise endothermic change in the thermal analysis measurement using a differential scanning calorimeter (DSC), which is a solid at a normal temperature (for example, 25° C.) and thermally plasticized at a temperature no lower than the glass transition temperature.

On the other hand, the crystalline resin refers to a resin having no stepwise endothermic change but having a definite endothermic peak in the measurement using a differential scanning calorimeter (DSC).

Specifically, for example, the crystalline resin means a resin having a half-value width of an endothermic peak in the measurement with a heating rate equal to or lower than 10° C./min of 10° C., and the amorphous resin refers to a resin having a half-value width exceeding 10° C., but having no definite endothermic peak observed.

First, the specific polyester resin will be described.

The specific polyester resin is a polyester resin having a rosin skeleton, and examples thereof include the constituents of polycondensates shown below.

Among these, from the viewpoint of chargeability, a polycondensate shown in 2), in which a monomer having a rosin is employed as a polyol, is favorable.

1) A polycondensate formed from polyvalent carboxylic acid components including polyvalent carboxylic acids having rosins, and if necessary, polyvalent carboxylic acid components including other polyvalent carboxylic acids, and polyol components including other polyols.

2) A polycondensate formed from polyvalent carboxylic acid components including other polyvalent carboxylic acids, and polyol components including polyols having rosins, and if necessary, other polyols.

3) A polycondensate formed from polyvalent carboxylic acid components including polyvalent carboxylic acids having rosins, and if necessary, other polyvalent carboxylic acids, and polyol components including polyols having rosins, and if necessary, other polyols.

4) A polycondensate formed from rosins, polyvalent carboxylic acid components including other polyvalent carboxylic acids, and polyol components including other polyols.

That is, examples of the monomers having a rosin include a rosin (rosin before modification), a polyvalent carboxylic acid having a rosin, and a polyol having a rosin. By using these monomers as the polycondensate components, the specific polyester resin is allowed to have a rosin (rosin skeleton).

However, the content of skeletons derived from the rosin included in the specific polyester resin (which is hereinafter referred to as the content of the rosin skeletons in some cases) is, for example, equal to or less than 70% by weight, preferably from 5% by weight to 70% by weight, and more preferably from 10% by weight to 45% by weight.

It is thought that with the content in the above-described range, the embedment of the external additive is suppressed, and also, suppression of the reduction in the charging amount of the toner is easily realized.

The content of the rosin skeleton is adjusted by the kind and the use amount of the monomer including the rosin in the synthesis of the specific polyester resin.

Herein, the content of the rosin skeletons means a proportion of the rosin skeletons (that is, the rosins bonded to the specific polyester resin) which is present in the specific polyester resin formed by the polycondensation of monomers including the rosins as the polycondensation components.

The content of the rosin skeletons is measured by separating the constituents of the specific polyester resin using NMR, LC-MS, GC-MS, or the like, and then quantifying them, thereby measuring the content in the resin.

Furthermore, other polyvalent carboxylic acids are carboxylic acids other than polyvalent carboxylic acids having rosins, and other polyols are polyols other than polyols having rosins.

Rosin

The rosin is a generic name for resin acids obtained from trees and shrubs, which is a material derived from natural products including abietic acid as one of tricyclic diterpenes and isomers thereof as a main component. Specific examples of the components of the rosin include palustric acid, neoabietic acid, pimaric acid, dehydroabietic acid, isopimaric acid, and sandaracopimaric acid, in addition to abietic acid, and the rosin used in the present exemplary embodiment is a mixture of these acids.

Rosins are classified broadly into tall rosin obtained from a pulp as a raw material, gum rosin obtained from raw pine tar as a raw material, and wood rosin obtained from the stump of a pine as a raw material.

As the rosin, at least one of gum rosin and tall rosin is preferable since it is easily available.

The rosin is preferably a purified rosin. The purified rosin is a polymeric material that is considered to be generated from peroxides of resin acids from unpurified rosins, or one obtained by removing unsaponifiable products included in the unpurified rosins.

The purification method is not particularly limited, but one is selected from various known purification methods. Specific examples thereof include distillation, recrystallization, and extraction. It is preferable to carry out purification by distillation from an industrial viewpoint. The distillation is usually chosen, taking into consideration the distillation time, at a temperature from 200° C. to 300° C. and a pressure equal to or less than 6.67 kPa. The recrystallization is carried out, for example, by dissolving an unpurified rosin in a good solvent, then evaporating the solvent to give a concentrated solution, and adding a poor solvent to the solution. Examples of the good solvent include aromatic hydrocarbons such as benzene, toluene, and xylene, chlorinated hydrocarbons such as chloroform, alcohols such as lower alcohols, ketones such as acetone, and acetic esters such as ethyl acetate, and examples of the poor solvent include hydrocarbon-based solvents such as n-hexane, n-heptane, cyclohexane, and isooctane. The extraction is a method including obtaining an aqueous alkaline solution of an unpurified rosin using, for example, alkaline water, extracting insoluble and unsaponifiable products included in the solution using an organic solvent, and then neutralizing the aqueous layer to obtain a purified rosin.

The rosin may be a disproportionated rosin. The disproportionated rosin is a mixture of dehydroabietic acid and dihydroabietic acid as a main component, in which by heating a rosin containing abietic acid as a main component at a high temperature in the presence of a disproportionation catalyst, leading to removal of unstable conjugated double bonds in the molecules.

Examples of the disproportionation catalyst include various known ones including supported catalysts such as palladium carbon, rhodium carbon, and platinum carbon, metal powders such as powders of nickel and platinum, iodine, and iodides such as iron iodide.

For the purpose of removing unstable conjugated double bonds in the molecules, the rosin may be a hydrogenated rosin. For the hydrogenation reaction, a known condition for a hydrogenation reaction is chosen. That is, the reaction is carried out by heating a rosin under hydrogen pressurization in the presence of a hydrogenation catalyst. Examples of the hydrogenation catalyst include various known ones including supported catalysts such as palladium carbon, rhodium carbon, and platinum carbon, metal powders such as nickel and platinum powders, iodine, and iodides such as iron iodide.

Furthermore, the disproportionated rosin and the hydrogenated rosin may include the purification step as described above before or after the disproportionation treatment or the hydrogenation treatment.

Polyvalent Carboxylic Acid Components

The polyvalent carboxylic acid having a rosin (which is hereinafter referred to as a carboxylic acid-modified rosin in some cases) is one formed by reacting rosins with α,β-unsaturated carboxylic acids (for example, α,β-unsaturated carboxylic acid or an acid anhydride thereof), and specific examples thereof include rosins modified with carboxylic acids (for example, (meth)acrylic acid, fumaric acid, maleic acid, maleic anhydride, itaconic acid, and citraconic acid (citraconic anhydride)).

Typical examples of the carboxylic acid-modified rosin include a (meth)acrylic acid-modified rosin, a fumaric acid-modified rosin, and a maleic acid-modified rosin.

Further, as the rosin before modification, the same as a rosin used as a polycondensation component of the specific polyester resin as described above is used.

The (meth)acrylic acid-modified rosin is a rosin modified with (meth)acrylic acid.

Specific examples of the (meth)acrylic acid-modified rosin include ones obtained by subjecting a rosin before modification to an addition reaction with (meth)acrylic acid, and more specific examples thereof include ones obtained through a Diels-Alder reaction between an acid having a conjugated double bond in the main component of the rosin before modification and (meth)acrylic acid while heating.

As the (meth)acrylic acid-modified rosin, an acrylic acid-modified rosin having low steric hindrance, which is formed by modification with acrylic acid, is preferable from a viewpoint of the reaction activity in the Diels-Alder reaction.

Furthermore, the "(meth)acryl" means acryl or methacryl. That is, the "(meth)acrylic acid" is acrylic acid or methacrylic acid. Further, the "(meth)acrylic acid-modified rosin" is a rosin modified with acrylic acid or a rosin modified with methacrylic acid.

In the (meth)acrylic acid-modified rosin, the modification degree of the rosin with (meth)acrylic acid (which is hereinafter referred to as a (meth)acrylic acid modification degree in some cases) is preferably from 5 to 105, more preferably from 20 to 105, even more preferably from 40 to 105, and even still more preferably from 60 to 105, from the viewpoint of increasing a molecular weight of the polyester and reducing low-molecular-weight oligomer components.

The (meth)acrylic acid modification degree Xa is calculated by the following formula (Aa), where the larger the value of the formula (Aa), the higher the degree of modification.

$$Xa=[(Xa1-Y)/(Xa2-Y)]\times 100 \qquad \text{Formula (Aa)}$$

In the formula (Aa), Xa1 represents an SP value of a (meth) acrylic acid-modified rosin of which a modification degree is calculated, Xa2 represents a saturated SP value of a (meth) acrylic acid-modified rosin obtainable by reacting one mole of (meth)acrylic acid and one mole of a rosin, and Y represents an SP value of the rosin.

Herein, the SP value means a softening point as determined with a ring-and-ball type automatic softening point tester. Specifically, the SP value is a value obtained by injecting a desired sample in a molten state into a ring, and then cooling the sample to room temperature (for example, 25° C.), and thereafter performing measurement under the following conditions on the basis of JIS B7410.

Measurement apparatus: Ring-and-Ball Type Automatic Softening Point Tester ASP-MGK2 (manufactured by MEITECH Co., Ltd.)

Heating rate: 5° C./min

Temperature at which heating is started: 40° C.

Measurement solvent: glycerine

Furthermore, the saturated SP value is an SP value when the reaction between (meth)acrylic acid and the rosin is carried out until a saturated value of an SP value of the obtained (meth)acrylic acid-modified rosin is attained.

A method for preparing a (meth)acrylic acid-modified rosin is not particularly limited, but for example, a (meth) acrylic acid-modified rosin may be obtained by the steps of mixing a rosin before modification and (meth)acrylic acid, and heating the mixture to a temperature from 180° C. to 260° C. (preferably from 180° C. to 210° C.), to carry out a Diels-Alder reaction, thereby adding (meth)acrylic acid to an acid containing a conjugated double bond contained in the rosin.

After the reaction, the (meth)acrylic acid-modified rosin may be used as it is or may be further purified through a procedure such as distillation, and then used.

The fumaric acid-modified rosin is a rosin modified with fumaric acid.

Specific examples of the fumaric acid-modified rosin include ones obtained by subjecting a rosin before modification to an addition reaction with fumaric acid, and more specific examples thereof include ones obtained through a Diels-Alder reaction between an acid having a conjugated double bond in the main component of the rosin before modification and fumaric acid while heating.

In the fumaric acid-modified rosin, the modification degree of the rosin with fumaric acid (which is hereinafter referred tows a fumaric acid modification degree in some cases) is preferably from 5 to 105, more preferably from 20 to 105, even more preferably from 40 to 105, and even still more preferably from 60 to 105, from the viewpoint of increasing the molecular weight of the polyester and increasing the glass transition temperature.

The fumaric acid modification degree Xf is calculated by the following formula (Af), where the larger the value of the formula (Af), the higher the degree of modification.

$$Xf=[(Xf1-Y)/(Xf2-Y)]\times 100 \qquad \text{Formula (Af)}$$

wherein Xf1 represents an SP value of a fumaric acid-modified rosin of which a modification degree is calculated, Xf2 represents an SP value of a fumaric acid-modified rosin obtainable by reacting one mole of fumaric acid and 0.7 mole of a rosin, and Y represents an SP value of the rosin.

Herein, the SP value means a softening point as determined with a ring-and-ball type automatic softening point tester, and specifically, a value measured by the method as described above.

A method for preparing a fumaric acid-modified rosin is not particularly limited, but for example, a fumaric acid-modified rosin may be obtained by the steps of mixing a rosin and fumaric acid, and heating the mixture to a temperature from 180° C. to 260° C. (preferably from 180° C. to 210° C.), to carry out a Diels-Alder reaction, thereby adding fumaric acid to an acid containing a conjugated double bond contained in the rosin.

After reaction, the fumaric acid-modified rosin may be used as it is or may be further purified through a procedure such as distillation and then used.

In the method for preparing a fumaric acid-modified rosin, it is preferable that the rosin and the fumaric acid be allowed to react in the presence of a phenol, by which the reaction efficiency between the rosin and the fumaric acid is easily increased.

The phenol is preferably a dihydric phenol and a phenolic compound having at least a substituent at an ortho-position to the hydroxyl group (which is hereinafter referred to as a hindered phenol in some cases), and the hindered phenol is more preferable.

The dihydric phenol means a compound in which two OH groups are bonded to a benzene ring, but other substituents are not bonded thereto, and specifically, for example, hydroquinone is preferable. Specific preferred examples of the hindered phenol include t-butylcatechol.

The amount of the phenol used is preferably from 0.001 part by weight to 0.5 part by weight, more preferably from 0.003 part by weight to 0.1 part by weight, and even more preferably from 0.005 part by weight to 0.1 part by weight, with respect to 100 parts by weight of the raw material monomers for the fumaric acid-modified rosin.

The maleic acid-modified rosin is a rosin modified with maleic acid or maleic anhydride.

Specific examples of the maleic acid-modified rosin include ones obtained by subjecting a rosin before modification to an addition reaction with maleic acid or maleic anhydride, and more specific examples thereof include ones obtained through a Diels-Alder reaction between an acid having a conjugated double bond in the main component of the rosin before modification and maleic acid or maleic anhydride while heating.

The rosin has a modification degree with maleic acid or maleic anhydride (which is hereinafter referred to as a maleic acid modification degree in some cases) of preferably from 30 to 105, more preferably from 40 to 105, even more preferably from 50 to 105, even more preferably from 60 to 105, and particularly preferably from 70 to 105, from the viewpoint of increasing a molecular weight of the polyester and reducing the low-molecular-weight oligomer components.

The maleic acid modification degree Xm is calculated by the following formula (Am), where the larger the value of the formula (Am), the higher the degree of modification.

$$Xm=[(Xm1-Y)/(Xm2-Y)]\times 100 \quad \text{Formula (Am)}$$

In the formula (Am), Xm1 represents an SP value of a maleic acid-modified rosin of which a modification degree is calculated, Xm2 represents an SP value of a maleic acid-modified rosin obtainable by reacting one mole of maleic acid and one mole of a rosin at 230° C., and Y represents a saturated SP value of the rosin.

Herein, the SP value means a softening point as determined with a ring-and-ball type automatic softening point tester, and specifically, a value measured by the method as described above.

Furthermore, the saturated SP value is an SF value when the reaction between maleic acid and the rosin is carried out until a saturated value of an SP value of the obtained maleic acid-modified rosin is attained.

A method for preparing a maleic acid-modified rosin is not particularly limited, but for example, a maleic acid-modified rosin may be obtained by the steps of mixing a rosin before modification and maleic acid or maleic anhydride, and heating the mixture to a temperature from 80° C. to 260° C. (preferably from 180° C. to 210° C.), to carry out a Diels-Alder reaction, thereby adding maleic acid or maleic anhydride to an acid containing a conjugated double bond contained in the rosin.

After the reaction, the maleic acid-modified rosin may be used as it is or may be further purified through a procedure such as distillation and then used.

Furthermore, the itaconic acid-modified rosin and the citraconic acid-modified rosin are synthesized in a similar manner to the modification degree as described above, and the modification degrees are calculated and determined.

This carboxylic acid-modified rosin is preferably contained in a proportion from 5% by weight to 70% by weight (preferably from 10% by weight to 60% by weight), with respect to the amount of the entire polyvalent carboxylic acid components.

Preferable examples of other polyvalent carboxylic acids include dicarboxylic acids. Examples of the dicarboxylic acid include at least one selected from the group consisting of aromatic dicarboxylic acids and aliphatic dicarboxylic acids, for example, aromatic dicarboxylic acids such as phthalic acid, isophthalic acid, terephthalic acid, 1,4-naphthalenedicarboxylic acid, and 2,6-naphthalenedicarboxylic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, dimeric acid, branched alkylsuccinic acids having 1 to 10 carbon atoms, and branched akenylsuccinic acids containing an alkenyl group having 1 to 20 carbon atoms; and anhydrides of these acids and alkyl (having 1 to 3 carbon atoms) esters of these acids. Among these, from the viewpoints of durability of a toner, fixability, and dispersibility of a colorant, the aromatic dicarboxylic acids are preferable.

Examples of other polyvalent carboxylic acids include trivalent or higher polyvalent carboxylic acids. Examples of the trivalent or higher polyvalent carboxylic acids include trimellitic acid, pyromellitic acid, and citric acid.

Polyol Components

Preferable examples of the polyol having a rosin include diols containing a rosin (which is hereinafter referred to as a rosin diol in some cases).

Herein, the rosin diol is a dialcohol compound containing a rosin that has two rosin ester groups in one molecule. Further, the rosin ester group refers to a residue formed by removing a hydrogen atom from a carboxyl group in the rosin.

The rosin diol may be synthesized by a known method, and may be synthesized, for example, by a reaction of a rosin with a bifunctional epoxy compound.

Furthermore, as the rosin used in the synthesis, those that are the same as rosins used for polycondensation components of polyester resins are used.

The reaction of a rosin with a bifunctional epoxy compound is usually effected by a ring-opening reaction of a carboxyl group in the rosin with an epoxy group in the bifunctional epoxy compound. Herein, the reaction temperature is preferably no lower than the melting temperature of both the constituents or a temperature at which homogeneous mixing is realized, and the temperature is generally specifically in the range from 60° C. to 200° C. During the reaction, a catalyst that promotes the ring-opening reaction of an epoxy group may be added.

Examples of the catalyst used for the reaction of a rosin with a bifunctional epoxy compound include amines such as ethylenediamine, trimethylamine, and 2-methylimidazole; quaternary ammonium salts such as triethylammonium bromide, triethylammonium chloride, and butyltrimethylammonium chloride; and triphenylphosphine.

The reaction of a rosin with a bifunctional epoxy compound is carried out by any of various methods, and the reaction progress is generally traced by, in the case of a batch type, putting a rosin and a bifunctional epoxy compound at a desired ratio into a flask capable of heating, which is equipped with a condenser, a stirrer, an inert gas inlet, a thermometer, and the like, heating and melting them, and sampling the reaction product. The degree of the reaction progress is usually confirmed by a decrease in the acid value, and the reaction is completed when the reaction reaches the end point of the stoichiometric reaction or near the end point.

The reaction ratio between the rosin and the bifunctional epoxy compound is not particularly limited, but the molar ratio of the rosin to the bifunctional epoxy compound is preferably from 1.5 moles to 2.5 moles of the rosin with respect to one mole of the bifunctional epoxy compound.

The bifunctional epoxy compound is a bifunctional epoxy compound containing two epoxy groups in one molecule. Examples of the bifunctional aromatic epoxy compound include diglycidyl ethers of aromatic diols and diglycidyl ethers of aromatic dicarboxylic acids, and examples of the bifunctional aliphatic epoxy compound include diglycidyl ethers of chained aliphatic diols, diglycidyl ethers of alicyclic diols, and alicyclic epoxides.

Typical examples of the diglycidyl ethers of aromatic diols include bisphenol A, derivatives of bisphenol A, such as a polyalkyleneoxide adduct of bisphenol A, bisphenol F, derivatives of bisphenol F such as a polyalkyleneoxide adduct of bisphenol F, bisphenol S, derivatives of bisphenol S, such as a polyalkyleneoxide adduct of bisphenol S, resorcinol, t-butylcatechol, and biphenol.

Typical examples of the diglycidyl ethers of aromatic dicarboxylic acids include terephthalic acid, isophthalic acid, and phthalic acid.

Typical examples of the diglycidyl ethers of chained aliphatic diols include ethylene glycol, 1,2-propanediol, 1,3-propanediol, 1,4-butanediol, 1,5-pentanediol, 1,6-hexanediol, neopentyl glycol, 1,9-nonanediol, diethylene glycol, triethylene glycol, polyethylene glycol, polypropylene glycol, and polytetramethylene glycol.

Typical examples of the diglycidyl ethers of alicyclic diols include hydrogenated bisphenol A, derivatives of hydrogenated bisphenol A, such as a polyalkyleneoxide adduct of hydrogenated bisphenol A, and cyclohexanedimethanol.

Typical examples of the alicyclic epoxide include limonene dioxide.

The bifunctional epoxy compound may be obtained, for example, by the reaction of a diol with an epihalohydrin, and may have a high molecular weight by performing polycondensation according to the amount ratio.

Hereinafter, the exemplary compounds of the rosin diol are shown below, but the present exemplary embodiments are not limited thereto.

col, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol, 1,10-decanediol, 3-hydroxy-2,2-dimethyl propyl-3-hydroxy-2,2-dimethylpropanoate, diethylene glycol, triethylene glycol, polyethylene glycol, dipropylene glycol, and polypropylene glycol. These aliphatic diols may be used alone or in combination of two or more kinds thereof.

The etherified diphenol includes diols obtained by subjecting bisphenol A and an alkylene oxide to an addition reaction, examples of the alkylene oxide include ethylene oxide and propylene oxide, and the average number of moles of the alkylene oxide added is preferably from 2 moles to 16 moles, with respect to one mole of the bisphenol A.

Examples of the method for preparing the specific polyester resin include well-known preparation methods in which the polyvalent carboxylic acid and the polyol are used as raw materials. As the reaction method, either of an esterification (1)

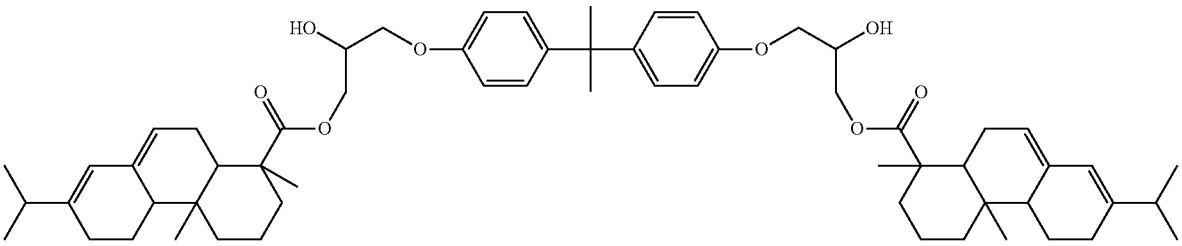

(2)

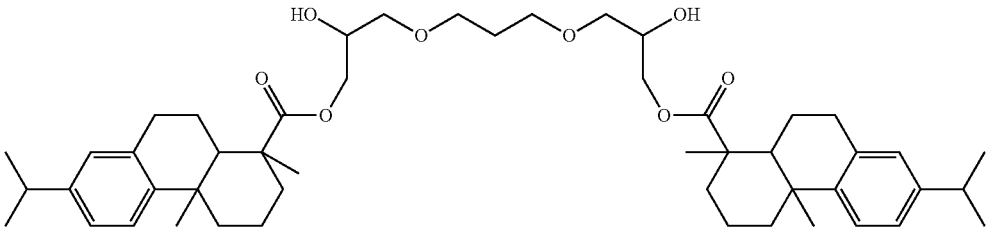

(3)

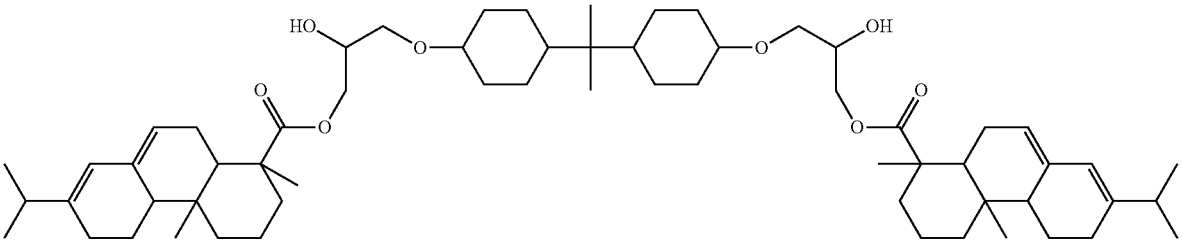

Furthermore, in the exemplary compounds of the rosin diol, n represents an integer of 1 or more.

The rosin dial (polyol having a rosin) is contained in a proportion from 15% by weight to 98% by weight (preferably from 20% by weight to 95% by weight), based on the entire alcohol components.

Examples of other polyols include at least one selected from the group consisting of aliphatic diols and etherified diphenols.

Examples of the aliphatic diol include ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glyreaction and a direct esterification reaction may be applicable. Further, it is possible to accelerate polycondensation by employing a process of conducting a reaction at a higher temperature under an increased pressure, a process of conducting a reaction under reduced pressure, or a process of conducting a reaction in a stream of an inert gas under an ordinary pressure. In the above-described reaction, a well-known reaction catalyst such as at least one metal compound selected from compounds of antimony, titanium, tin, zinc, aluminum, and manganese may be used to accelerate the reaction. The addition amount of the reaction catalyst is preferably from 0.01 part by weight to 1.5 parts by weight, and more preferably from 0.05 part by weight to 1.0 part by weight, with respect to 100 parts by weight of the total amount of the polyvalent carboxylic acid and the polyol. The reaction is carried out, for example, at a temperature from 180° C. to 300° C.

Furthermore, when the specific polyester resin is hydrolyzed, it is decomposed into monomers (polyvalent carboxylic acid components and polyol components). The specific polyester resin is, for example, a 1:1 condensate of a polyvalent carboxylic acid (for example, a dicarboxylic acid) and a polyol (for example, a diol), and thus, the configuration of the resin is evaluated from the decomposed products.

(Characteristics of Specific Polyester Resin)

The weight average molecular weight of the specific polyester resin is preferably from 4000 to 1000000, and more preferably from 7000 to 300000, from the viewpoints of durability and anti-offset properties of the toner.

Furthermore, the molecular weight of the specific polyester resin is measured in the following manner.

Two columns of "HLC-8120 GPC, SC-8020 (manufactured by Tosoh Corp., 6.0 mm ID×15 cm)" are used, and THF (tetrahydrofuran) is used as an eluent. As for the experimental conditions, measurement is carried out using a sample concentration of 0.5%, a flow rate of 0.6 ml/min, a sample injection amount of 10 μl, a measurement temperature of 40° C., and an RI detector. Further, the calibration curve is prepared by using 10 samples of "Polystyrene Standard Samples TSK Standards": "A-500", "F-1", "F-10", "F-80", "F-380", "A-2500", "F-4", "F-40", "F-128", and "F-700", manufactured by Tosoh Corp.

Moreover, the softening temperature of the specific polyester resin is preferably from 80° C. to 160° C., and more preferably from 90° C. to 150° C., from the viewpoints of the fixability, preservation, and durability of a toner.

Incidentally, the softening point is determined as a temperature corresponding to the center value between the temperatures of initiation and termination of flow when a 1 $cm^3$ sample is melted and allowed to flow in an elevated flow tester CFT-500 (manufactured by Shimadzu Co.), under the conditions of a dice micropore diameter of 0.5 mm, an applied load of 0.98 MPa (10 $kg/cm^2$), and a heating rate of 1° C./min.

The glass transition temperature of the specific polyester resin is preferably from 35° C. to 80° C., and more preferably from 40° C. to 70° C., from the viewpoints of the fixability, preservation, and durability. The softening temperature and the glass transition temperature are easily adjusted by adjusting the compositions of raw material monomers, polymerization initiators, molecular weights, the amount of catalysts, or the like, or by selecting the reaction conditions.

In addition, the glass transition temperature is measured by heating 10 mg of a sample at a constant heating rate (10° C./min) using a "DSC-20" (manufactured by Seiko Industries and Electronics Co.).

The acid value of the specific polyester resin is preferably from 1 mg KOH/g to 50 mg KOH/g, and more preferably from 3 mg KOH/g to 30 mg KOH/g, from a viewpoint of chargeability of a toner.

Furthermore, the acid value is measured using a neutralization titration method in accordance with JIS K0070. That is, a suitable amount of a sample is prepared, 100 ml of a solvent (mixed liquid of diethyl ether/ethanol) and a few drops of a reagent (phenolphthalein solution) are added, sufficient stirring and mixing in a water bath are performed until the sample dissolves. This is titrated with a 0.1 mol/l potassium hydroxide/ethanol solution and an end point is reached when the pale red color of the reagent remains for 30 seconds. When the acid value is denoted as A, the amount of a sample is denoted as S (g), the amount of the 0.1 mol/l potassium hydroxide/ethanol solution used in the titration is denoted as B (ml), and f is taken as a factor of the 0.1 mol/l potassium hydroxide/ethanol solution, $A=(B\times f\times 5.611)/S$ is calculated.

The specific polyester resin may be a modified polyester resin. Examples of the modified polyester include polyesters that have been grafted or blocked with phenol, urethane, epoxy, or the like according to the method described in JP-A-11-133668, JP-A-10-239903, JP-A-08-20636, or the like.

—Other Amorphous Resin—

Examples of the amorphous resin other than the specific polyester resin include known binder resins, for example, vinyl-based resins such as styrene-acryl resin, and other resins such as epoxy resins, polycarbonate, and polyurethane.

—Crystalline Resin—

Examples of the crystalline resin include a crystalline polyester resin, a polyalkylene resin, and a long-chain alkyl(meth) acrylate resin, but from the viewpoints that a drastic change in the viscosity is further exhibited due to heating, and both of the mechanical strength and the low-temperature fixability are satisfied, the crystalline polyester resin is preferable.

As the crystalline polyester resin, for example, from a viewpoint of realizing the low-temperature fixability, a condensation polymer obtained from an aliphatic dicarboxylic acid (including an acid anhydride and an acid chloride thereof) and an aliphatic diol is preferable.

The content of the crystalline resin is preferably from 1 part by weight to 20 parts by weight, and more preferably from 5 parts by weight to 15 parts by weight, with respect to 100 parts by weight of all the binder resins.

Furthermore, in the present exemplary embodiment, the low-temperature fixing refers to fixing while heating the toner at a temperature equal to or lower than about 120° C.

—Colorant—

The colorant may be, for example, either of a dye and a pigment, but it is preferably a pigment from the viewpoints of light resistance and water resistance.

As the colorant, known pigments such as carbon black, aniline black, aniline blue, charcoyl blue, chrome yellow, ultramarine blue, DuPont oil red, quinoline yellow, methylene blue chloride, phthalocyanine blue, malachite green oxalate, lamp black, rose bengal, quinacridone, benzidine yellow, C. I. Pigment•Red 48:1, C. I. Pigment•Red 57:1, C. I. Pigment•Red 122, C. I. Pigment•Red 185, C. I. Pigment•Red 238, C. I. Pigment•Yellow 12, C. I. Pigment•Yellow 17, C. T. Pigment•Yellow 180, C. I. Pigment•Yellow 97, C. T. Pigment•Yellow 74, C. I. Pigment•Blue 15:1, and C. I. Pigment•Blue 15:3 may be used.

As a colorant, a colorant whose surface is treated, as necessary, or a pigment dispersant may be used.

By selecting the type of the colorant, a yellow toner, a magenta toner, a cyan toner, a black toner, or the like may be obtained.

The content of the colorant is preferably in the range of 1 part by weight to 30 parts by weight with respect to 100 parts by weight of the binder resin.

—Release Agent—

Specific examples of the release agent include paraffin waxes such as low-molecular-weight polypropylene and low-molecular-weight polyethylene; silicone resins; rosins; rice wax; and carnauba wax. The melting temperature of the release agent is preferably from 50° C. to 100° C., and more preferably from 60° C. to 95° C.

The content of the release agent is preferably from 0.5 part by weight to 15 parts by weight, and more preferably from 1.0 part by weight to 12 parts by weight, with respect to 100 parts by weight of the binder resin.

When the content of the release agent is equal to or more than 0.5% by weight, occurrence of peeling failure is prevented, particularly in oil-less fixing. When the content of the release agent is equal to or less than 15% by weight, the flowability of the toner is not deteriorated, and the image quality and the reliability in the image formation are improved.

—Other Additives—

As a charge control agent, known charge control agents may be used, but for example, an azo-based metal complex compound, a salicylic acid metal complex compound, or a charge control agent of a resin type containing a polar group may be used.

—Characteristics of Toner Particles—

The toner particles may be toner particles having a monolayer structure, or toner particles having a core/shell structure, which is constituted by a core (core particles) and a coating layer (shell layer) that is coated on the core.

The toner particles having a core/shell structure are preferably constituted by, for example, a core including a binder resin (a specific polyester resin and a crystalline polyester resin), and if necessary, other additives such as a colorant and a release agent, and a coating layer including a binder resin (a polyester resin according to the present exemplary embodiment).

The volume average particle diameter of the toner particles is preferably, for example, from 2.0 μm to 10 μm, and more preferably from 3.5 μm to 7.0 μm.

Furthermore, as for a method for measuring the volume average particle diameter of the toner particles, 0.5 to 50 mg of a sample for measurement is added to 2 ml of a surfactant, preferably a 5-%-by-weight sodium alkylbenzenesulfonate aqueous solution, as a dispersant. The mixture is added to 100 ml to 150 ml of the electrolyte solution. The electrolyte solution in which the measurement sample is suspended is subjected to a dispersion treatment with an ultrasonic dispersing machine for 1 minute, and the particle size distribution of particles having a particle diameter in the range from 2.0 μm to 60 μm is determined by means of a COULTER MULTISIZER Type II (manufactured by Beckmann Coulter Inc.) by using an aperture having an aperture diameter of 100 μm. The number of the particles to be measured is 50,000.

The obtained particle size distribution is divided into particle size ranges (channels), and a volume cumulative distribution is drawn from the smaller particle size end. A particles diameter corresponding to 50% in the cumulative distribution is determined as a volume average particle diameter D50v.

The shape factor SF1 of the toner particles is preferably from 110 to 150, and more preferably from 120 to 140.

Herein, the shape factor SF1 is determined by the following formula (1):

$$SF1=(ML^2/A)\times(\pi/4)\times 100 \qquad \text{Formula (1)}$$

In the formula (1), ML represents the absolute maximum length of the toner and A represents the projected area of the toner.

Further, the SF1 value may be typically obtained by analyzing an image captured by a microscope or a scanning electron microscope (SEM) by means of an image analyzer and calculated as a numerical value, for examples, as described below. That is, the SF1 value may be obtained by inputting an optical microscopic image of particles sprayed on the surface of a slide glass via a video camera into a LUZEX image analyzer, determining the maximum length and the projected area of 100 particles, calculating the values by the formula (1) above, and then averaging the values.

(External Additives)

Examples of the external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surface of the inorganic particles as the external additives may be subjected to a hydrophobic treatment in advance. The hydrophobic treatment is carried out by, for example, immersing inorganic particles in a hydrophobic treatment agent. The hydrophobic treatment agent is not particularly limited, but examples thereof include a silane-based coupling agent, a silicone oil, a titanate-based coupling agent, and an aluminum-based coupling agent. These may be used alone or in combination of two or more kinds thereof.

The amount of the hydrophobic treatment agent is usually, for example, from about 1 part by weight to 10 parts by weight with respect to 100 parts by weight of the inorganic particles.

Examples of the external additive include resin particles (resin particles of polystyrene, PMMA, melamine resins, or the like), and cleaning activators (for example, metal salts of higher fatty acids, typically represented by zinc stearate, or particle powders of fluorine-based polymers).

The external addition amount of the external additive is, for example, preferably from 0.01 part by weight to 5 parts by weight, and more preferably from 0.01 part by weight to 2.0 parts by weight, with respect to 100 parts by weight of the toner particles.

The primary particle diameter of the external additive is, for example, preferably from 5 nm to 2 μm, and more preferably from 5 nm to 500 nm.

(Method for Preparing Toner)

Hereinafter, the method for preparing a toner will be described.

First, the toner particles containing a specific polyester resin may be prepared by any one of a dry preparation method (for example, a kneading milling method), a wet preparation method (for example, an aggregation and coalescence method, a suspension polymerization method, a dissolution-suspension granulation method, a dissolution-suspension method, a dissolution-emulsification aggregation and coalescence method). The preparation method is not particularly limited, and any one of well-known preparation methods may be selected and used.

Among these methods, it is preferable to obtain toner particles by an aggregation and coalescence method.

Furthermore, the toner is prepared, for example, by adding the external additive to the dried toner particles thus obtained and mixing them. The mixing is preferably carried out using, for example, a V blender, a Henschel mixer, a Loedige mixer, or the like. In addition and if necessary, coarse particles of the toner may be removed using a vibrating pulverizer, a wind classifier, or the like.

<Carrier>

The carrier has a core material particle and a coating resin layer which coats the surface of the core material particles.

The details on the carrier will be provided below.

(Core Material Particles)

As the core material particles, any known particles used as the core material particles for a carrier may be used, but examples thereof include magnetic particles, and specifically, magnetic metal particles (for example, particles of iron, steel, nickel, cobalt, or the like), magnetic oxide particles (for example, particles of ferrite, magnetite, or the like). For example, the particles may be magnetic particle dispersion type resin particles in which the particles are dispersed in a resin.

(Coating Resin Layer)

The hardness of the coating resin layer is from 1.2 times to 2.0 times that of the toner particles.

The resin for the coating resin layer may be any resin that satisfies the hardness as described above, and examples thereof include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin having organosiloxane bonds and a modified product thereof, fluororesin, a polyester, a polycarbonate, a phenolic resin, an epoxy resin, and an acrylic resin.

Herein, preferable examples of the resin for the coating resin layer satisfying the hardness above include resins including at least one selected from dicyclopentanyl(meth)acrylate, isobornyl(meth)acrylate, adamantyl(meth)acrylate, and norbornyl(meth)acrylate and hydroxynaphthyl(meth)acrylate as a polymerization component, and more preferably resins including at least one selected from dicyclopentanyl(meth)acrylate and isobornyl(meth)acrylate as a polymerization component.

It is thought that when the coating resin layer has a configuration where the resin for the coating resin layer includes at least one selected from the above-described polymerization components as a polymerization component, it tends to easily realize the hardness above, and thus to easily exhibit the effect of the present application.

The reason for this is presumed that since the above-described polymerization components have a structure in which a group having a high molecular weight is bonded to an ester group of (meth)acrylic acid, when a resin is formed from polymerization, the hardness is easily realized.

In addition, it is thought that when the coating resin layer has a configuration where the resin for the coating resin layer includes at least one selected from the above-described polymerization components as a polymerization component, peeling is suppressed.

As the polymerization component of the resin for the coating resin layer, other polymerization components may be included for the purpose of adjusting the hardness of the coating resin layer, in addition to the polymerization components above.

Specific examples of other polymerization components include (meth)acrylic acid, methyl(meth)acrylate, ethyl(meth)acrylate, propyl(meth)acrylate, styrene, and diethylaminoethyl(meth)acrylate.

The content of dicyclopentanyl(meth)acrylate, isobornyl(meth)acrylate, adamantyl(meth)acrylate, norbornyl(meth)acrylate, or hydroxynaphthyl(meth)acrylate, which is the polymerization component of the resin for the coating resin layer, is preferably from 30% by weight to 95% by weight, more preferably from 50% by weight to 85% by weight, and even more preferably from 60% by weight to 80% by weight, with respect to the entire polymerization components in the resin for the coating resin layer, from the viewpoints that the hardness of the coating resin layer is realized and thus, the peeling of the coating resin layer is suppressed.

The work function of the coating resin layer of the carrier is preferably equal to or less than 4.55 eV.

It is thought that when the work function of the coating resin layer is equal to or less than 4.55 eV, it tends to become lower than that of the specific polyester resin included in the toner particles, and therefore, the ability of providing the toner with charges is improved.

The work function of the coating resin layer is preferably from 4.2 eV to 4.5 eV, and more preferably from 4.3 eV to 4.4 eV.

The work function of the coating resin layer is calculated as follows.

A coating resin is dissolved in tetrahydrofuran to obtain a 2%-by-weight solution in tetrahydrofuran. The solution is applied on a gold-plated brass base and tetrahydrofuran is evaporated to obtain a thin film having a thickness of about 0.5 μm. Thereafter, the solution is dried in an oven at 120° C. for 5 hours to obtain a sample for measurement. Under the environment with a temperature of 23° C. and a humidity of 50%, a contact potential difference between a reference electrode and a sample base coated with the coating resin in a contact potential difference measurement apparatus using a Kelvin probe is obtained. The work function of the reference electrode is measured with a photoelectron emission apparatus (AC2 manufactured by Riken Keiki Co. Ltd.), and the contact potential difference is subtracted from the work function of the reference electrode to give a value as the work function of a coating resin. When the work function of the coating resin is lower than that of the reference electrode, the contact potential difference is positive, or otherwise it is negative. Further, for the details on this, refer to "Case Studies of Measurement/Evaluation and Control/Use of Work Function/Ionization Potential (2010)" of JOHOKIKO Co., Ltd.

Furthermore, the work function of the specific polyester resin included in the toner particles is calculated in a similar manner.

For example, other additives such as conductive materials may also be included in the coating resin layer.

Examples of the conductive particles include carbon black, various metal powders, and metal oxides such as titanium oxide, tin oxide, magnetite, and ferrite. These may be used alone or in combination of two or more kinds thereof. Among these, in terms of good preparation stability, cost, conductivity, or the like, carbon black particles are preferable. The type of carbon black is not particularly limited, but carbon black having a DBP oil absorption amount from about 50 ml/100 g to 250 ml/100 g is preferable in terms of excellent preparation stability.

In order to form a coating resin layer on the surface of the core material particles, for example, a method in which a coating resin, and if necessary, various additives are dissolved in a suitable solvent, and a solution for forming a coating resin layer thus formed is coated may be mentioned. The solvent is not particularly limited, and may be selected appropriately in consideration of the type of the coating resin used and/or suitability for coating.

Specific examples of the method include a dipping method in which core material particles are dipped in a solution for forming a coating resin layer, a spray method in which a solution for forming a coating layer is sprayed on the surface of core material particles, a fluidized bed method in which a solution for forming a coating resin layer is sprayed while core material particles are floated by fluidizing air, and a kneader coater method in which core material particles of a carrier are mixed with a solution for forming a coating resin layer in the kneader coater, and the solvent is removed.

Herein, the amount of the coating resin layer coated on the core material particle is, for example, preferably 0.5% by weight or more (more preferably from 0.7% by weight to 6% by weight, and even more preferably from 1.0% by weight to 5.0% by weight), with respect to the total weight of the carrier.

This coating amount is determined as follows.

In the case of a coating resin that is soluble in a solvent, a carrier that has been accurately weighed is dissolved in a soluble solvent (for example, toluene), the magnetic powder is held with a magnet, and the solution in which the coating resin is dissolved is removed by rinsing. By repeating this operation several times, the magnetic powder from which the coating resin has been removed remains. The weight of the magnetic powder after being dried is measured, and then the difference is divided by the amount of carrier to calculate the coating amount.

Specifically, 20.0 g of a carrier is weighed and placed in a beaker, 100 g of toluene is added thereto, and the mixture is stirred with a stirring blade for 10 minutes. A magnet is placed under the bottom of the beaker, followed by rinsing with toluene in such a way that the core material (magnetic powder) may not flow out. This operation is repeated four times and the beaker after rinsing is dried. After the drying, the amount of magnetic powder is measured and the coating amount is calculated using a formula [(the amount of a carrier–the amount of magnetic powder after washing)/the amount of the carrier].

On the other hand, in the case of a coating resin that is insoluble in a solvent, the carrier is heated under a nitrogen atmosphere at a temperature in the range from room temperature (25° C.) to 1000° C. using a Thermo plus EVO II Differential Thermogravimetric Analyzer TG8120 manufactured by Rigaku Corporation, and the coating amount is calculated from the decrease in the weight of the carrier.

(Method for Preparing Developer)

The electrostatic charge image developer according to the present exemplary embodiment is a two-component developer formed by mixing a toner and the carrier.

The mixing ratio (weight ratio) of the toner and the carrier in the two-component developer is such that the ratio of toner:carrier is in the range of about 1:100 to 30:100, and more preferably about 3:100 to 20:100.

[Image Forming Apparatus/Image Forming Method]

Next, the image forming apparatus/image forming method according to the present exemplary embodiment will be described.

The image forming apparatus according to the present exemplary embodiment has an image holding member, a charging unit that charges a surface of the image holding member, an electrostatic charge image forming unit that forms an electrostatic charge image on the surface of the charged image holding member, a developing unit that accommodates an electrostatic charge image developer and develops the electrostatic charge image formed on the image holding member by the electrostatic charge image developer to form a toner image, a transfer unit that transfers the toner image formed on the image holding member onto a recording medium, and a fixing unit that fixes the toner image transferred onto the recording medium. In addition, as the electrostatic charge image developer, the electrostatic charge image developer according to the present exemplary embodiment is employed.

Furthermore, in the image forming apparatus according to the present exemplary embodiment, for example, a portion including the developing unit may be a cartridge structure (process cartridge) that is attached to or detachable from the image forming apparatus, and as the process cartridge, for example, a process cartridge which accommodates the electrostatic charge image developer according to the present exemplary embodiment and includes a developing unit is preferably used.

The image forming method according to the present exemplary embodiment includes a step of charging a surface of an image holding member, a step of forming an electrostatic charge image on the surface of the charged image holding member, a step of holding an electrostatic charge image developer and developing the image formed on the image holding member by the electrostatic charge image developer to form a toner image, a step of transferring the toner image formed on the image holding member onto a recording medium, and a step of fixing the toner image transferred onto the recording medium. In addition, as the electrostatic charge image developer, the electrostatic charge image developer according to the present exemplary embodiment is employed.

Hereinafter, an example of the image forming apparatus according to the present exemplary embodiment will be described, but the invention is not limited thereto. Further, the essential portions shown in the drawings are described and the description of other portions is omitted.

FIG. 1 is a schematic configuration diagram showing a four-tandem color image forming apparatus. The image forming apparatus shown in FIG. 1 has first to fourth electrophotographic image forming units 10Y, 10M, 10C, and 10K (image forming units) that output the images of colors of yellow (Y), magenta (M), cyan (C), and black (K), respectively, based on color-separated image data. These image forming units (which will be hereinafter simply referred to as a "unit" in some cases) 10Y, 10M, 10C, and 10K are disposed side by side at predetermined intervals in the horizontal direction. Further, these units 10Y, 10M, 10C, and 10K may be process cartridges that are attached to or detached from the main body of the image forming apparatus.

In the upper part in the drawing of the respective units 10Y, 10M, 10C, and 10K, an intermediate transfer belt 20 is connected as an intermediate transfer medium through the respective units. The intermediate transfer belt 20 is wound around a driving roller 22 that is disposed apart from each other in the direction from the left to the right in the drawing and a support roller 24 which is in contact with the inner surface of the intermediate transfer belt 20, in such a manner as to move in the direction from the first unit 10Y to the fourth unit 10K. Further, to the support roller 24, force is applied by a spring or the like, not shown, in the direction separating from the driving roller 22, and tension is applied to the intermediate transfer belt 20 wound around both the rollers. To the image holding member side of the intermediate transfer belt 20, an intermediate transfer medium cleaning device 30 is disposed so as to face the driving roller 22.

Further, to developing devices (developing units) 4Y, 4M, 4C, and 4K of the respective units 10Y, 10M, 10C, and 10K, toners of four colors of yellow, magenta, cyan, and black stored in the corresponding toner cartridges 8Y, 8M, 8C, and 8K are supplied, respectively.

The first to fourth units 10Y, 10M, 10C, and 10K as described above have the same structure, and therefore, the first unit 10Y forming a yellow image, which is disposed upstream of the travel direction of the intermediate transfer belt, is described as a typical example. The description of the second to fourth units 10M, 100, and 10K is omitted by designating the portions equivalent to those of the first unit 10Y with magenta (M), cyan (C), and black (K) in place of yellow (Y).

The first unit 10Y has a photoreceptor 1Y that acts as the image holding member. Around the photoreceptor 1Y, a charging roller 2Y that charges the surface of the photoreceptor 1Y to a predetermined potential, an exposure device (electrostatic latent image forming unit) 3 that exposes the charged surface with a laser beam 3Y based on a color-separated image signal to form an electrostatic charge image, a developing device (developing unit) 4Y that supplies a charged toner to the electrostatic latent image to develop the electrostatic latent image, a primary transfer roller 5Y (primary transfer unit) that transfers the developed toner image onto the intermediate transfer belt 20, and a photoreceptor cleaning device (cleaning unit) 6Y that removes the toner remaining on the surface of the photoreceptor 1Y after the primary transfer, are disposed in order.

Further, the primary transfer roller 5Y is disposed inside the intermediate transfer belt 20, and is disposed at the position facing the photoreceptor 1Y. Furthermore, a bias power supply (not shown) that applies a primary transfer bias is connected to each of primary transfer rollers 5Y, 5M, 5C, and 5K. Each bias power supply varies the transfer bias applied to each primary transfer roller by the control of a control unit not shown.

Hereinafter, an operation for forming a yellow image in the first unit 10Y will be described. First, prior to the operation, the surface of the photoreceptor 1Y is charged by the charging roller 2Y to a potential of about −600 V to about −800 V.

The photoreceptor 1Y is formed by lamination of a photosensitive layer disposed on a conductive (volume resistivity at 20° C.: equal to or less than $1\times10^{-6}$ Ωcm) substrate. The photosensitive layer usually has a high resistance (resistance same or similar to that of general resins). When the photosensitive layer is irradiated with the laser beam 3Y, the specific resistance of the laser beam-irradiated portions changes. Then, the laser beam 3Y is emitted to the surface of the charged photoreceptor 1Y through the exposure device 3 according to yellow image data transmitted from a control unit, not shown. The laser beam 3Y is emitted to the photosensitive layer on the surface of the photoreceptor 1Y, and thus an electrostatic charge image having a yellow printing pattern is formed on the surface of the photoreceptor 1Y.

The electrostatic charge image is an image formed on the surface of the photoreceptor 1Y by charging, and is a so-called negative latent image that is formed when the specific resistance of the irradiated portion of the photosensitive layer is reduced by the laser beam 3Y and the charged charges on the surface of the photoreceptor 1Y flow, and, in contrast, when the charges in a portion not irradiated with the laser beam 3Y remain.

The electrostatic charge image thus formed on the photoreceptor 1Y is rotated to the predetermined development position according to the movement of the photoreceptor 1Y. Then, the electrostatic charge image on the photoreceptor 1Y is formed into a visible image (developed image) by the developing device 4Y at the development position.

In the developing device 4Y, an electrostatic charge image developer according to the present exemplary embodiment containing at least a yellow toner and a carrier, for example is accommodated. The yellow toner is stirred in the developing device 4Y, thereby frictionally charging the toner, and is held on a developer roll (developer holding member) while having the charges with same polarity (negative polarity) as that of the charges on the photoreceptor 1Y. When the surface of the photoreceptor 1Y passes through the developing device 4Y, the yellow toner electrostatically adheres to a charge-erased latent image portion on the surface of the photoreceptor 1Y, and thus the latent image is developed by the yellow toner. The photoreceptor 1Y on which the yellow toner image is formed successively moves at a predetermined rate, and the toner image developed on the photoreceptor 1Y is transported to a primary transfer position.

When the yellow toner image on the photoreceptor 1Y is transported to the primary transfer, a primary transfer bias is applied to the primary transfer roller 5Y, static electricity force directing to the primary transfer roller 5Y from the photoreceptor 1Y acts on the toner image, and then the toner image on the photoreceptor 1Y is transferred to the intermediate transfer belt 20. The transfer bias applied at this time has a (+) polarity reverse to the polarity (−) of the toner, and is controlled to, for example, about +10 μA by a control unit (not shown) in the first unit 10Y.

On the other hand, the toner remaining on the photoreceptor 1Y is removed and collected by the cleaning device 6Y.

Further, the primary transfer bias applied to the primary transfer rollers 5M, 5C, and 5K subsequent to the second unit 10M is also controlled in accordance with the first unit.

Thus, the intermediate transfer belt 20 to which the yellow toner image is transferred by the first unit 10Y is sequentially transported through the second to fourth units 10M, 10C, and 10K, toner images of the respective colors are overlapped therewith, and multi-transfer is achieved.

The intermediate transfer belt 20 to which the toner images of four colors are multi-transferred through the first to fourth units reaches a secondary transfer portion formed by the intermediate transfer belt 20, the support roller 24 in contact with the inner surface of the intermediate transfer belt, and a secondary transfer roller (secondary transfer unit) 26 disposed at the image holding surface side of the intermediate transfer belt 20. A recording paper (recording medium) P is supplied through a supply mechanism at a predetermined timing to a portion where the secondary transfer roller 26 and the intermediate transfer belt 20 are pressed against each other, and the secondary transfer bias is applied to the support roller 24. The transfer bias applied at this time has the same (−) polarity as the polarity (−) of the toner, static electricity force directing to the recording paper P from the intermediate transfer belt 20 acts on the toner image, and thus the toner image on the intermediate transfer belt 20 is transferred to the recording paper P. The secondary transfer bias in this case is determined according to the resistance detected by a resistance detection unit (not shown) that detects the resistance of the secondary transfer portion, and the voltage is controlled.

Thereafter, the recording paper P is transported to a pressurized portion (nip portion) of a pair of fixing rolls in a fixing device (roll-shaped fixing unit) 28, the toner image is fixed on the recording paper P to form a fixed image.

Examples of the recording medium onto which the toner image is transferred include regular paper and OHP sheets used in a copier or printer in an electrophotographic system.

For further improving the smoothness of the surface of an image after fixation, a smooth surface of the reading medium is also preferred, and for example, coated paper formed by coating a resin or the like on the surface of plain paper, art paper for printing, or the like is preferably used.

After the completion of the fixing of the color image on the recording paper P, the recording paper P is discharged to a discharging portion and a series of color image forming operations are completed.

In the image forming apparatus described above as an example, the toner image is transferred to the recording paper P through the intermediate transfer belt 20. However, the configuration of the image forming apparatus is not limited thereto, and the toner image may be directly transferred to the recording paper from the photoreceptor.

(Process Cartridge and Toner Cartridge)

Figure 2:
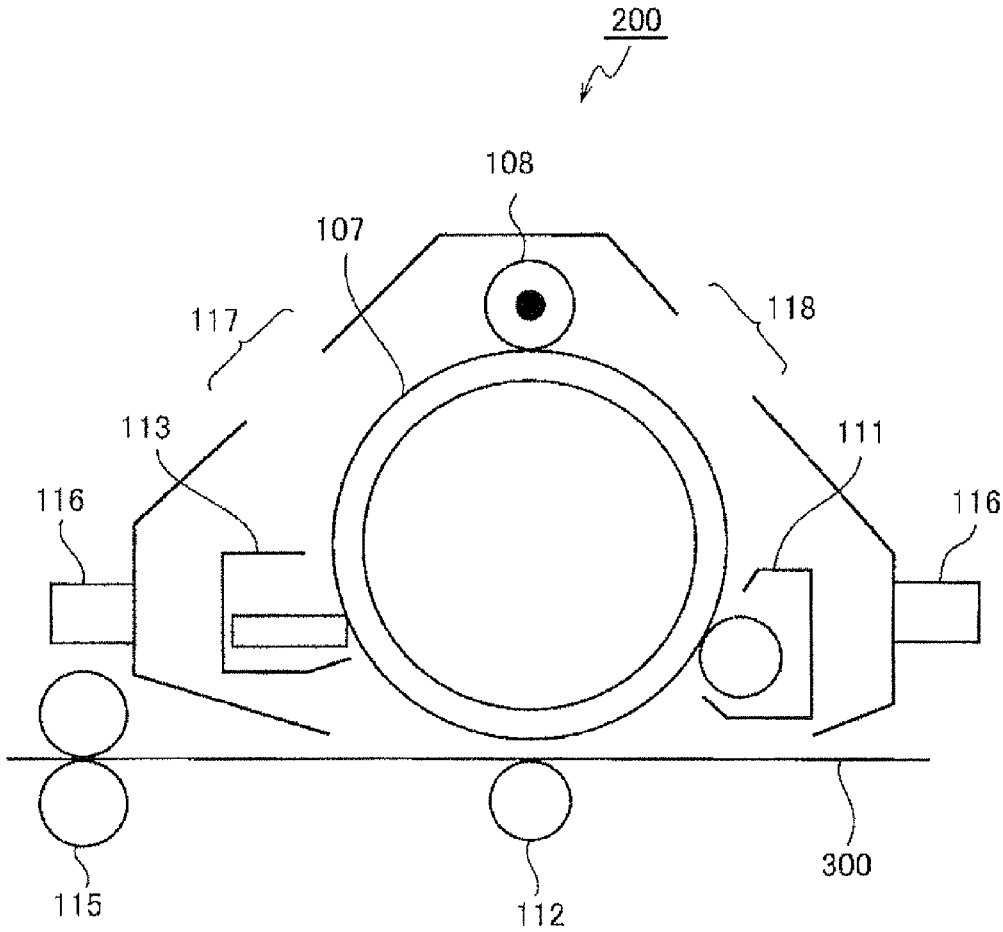
FIG. 2 is a schematic configuration diagram showing an example of the process cartridge according to the present exemplary embodiment.

FIG. 2 is a schematic configuration diagram showing a preferred exemplary embodiment of an example of the process cartridge that accommodates the electrostatic charge image developer according to the present exemplary embodiment. A process cartridge 200 includes a photoreceptor 107, a charging roller 108, a developing device 111, a photoreceptor cleaning device 113, an opening 118 for exposure, and an opening 117 for exposure for erasing charges, which are combined and integrated using a installed rail 116. In FIG. 2, the reference number 300 designates a recording medium.

Further, the process cartridge 200 is formed with materials that are attached to and detached from an image forming apparatus including a transfer device 112, a fixing device 115, and additional components not shown.

The process cartridge 200 shown in FIG. 2 includes the charging device 108, the developing device 111, the cleaning device 113, the opening 118 for exposure, and the opening 117 for exposure for erasing charges, but the devices may be selectively combined. The process cartridge according to the exemplary embodiment includes the photoreceptor 107, and at least one selected from the group consisting of the charging device 108, the developing device 111, the cleaning device (cleaning unit) 113, the opening 118 for exposure, and the opening 117 for exposure for erasing charges.

Next, the toner cartridge according to the present exemplary embodiment will be described. The toner cartridge according to the present exemplary embodiment is a toner cartridge that is attachable to or detachable from the image forming apparatus and accommodates at least a toner for developing an electrostatic charge image for distribution to be supplied to a developing unit provided in the image forming apparatus.

Further, the image forming apparatus shown in FIG. 1 is an image forming apparatus having a structure in which the toner cartridges 8Y, 8M, 8C, and 8K are attachably or detachably provided. The developing devices 4Y, 4M, 4C, and 4K are connected to toner cartridges corresponding to the respective developing devices for respective colors by a toner supply pipe, not shown. Further, when the amount of the toner accommodated in the toner cartridge becomes low, the toner cartridge is exchanged.

EXAMPLES

Hereinbelow, the present exemplary embodiments will be described with reference to Examples, but are not limited to the Examples shown below. Further, in the Examples, unless otherwise specified, "part (s)" and "%" mean "part (s) by weight" and "% by weight", respectively.

[Toner]

<Carboxylic Acid-Modified Rosin>

(Synthesis of Fumaric Acid-Modified Rosin)

500 g of a tall rosin and 100 g of fumaric acid are put into a 2-1, flask equipped with a separation tube and a condenser, and the mixture is allowed to undergo a reaction at 200° C. for 4 hours to obtain a fumaric acid-modified rosin (fumaric acid-modified abietic acid).

For the characteristics of the obtained fumaric acid-modified rosin, the modification degree is 85.

(Synthesis of Maleic Acid-Modified Rosin)

500 g of a purified rosin and 100 g of maleic anhydride are added to a 2-L, flask, and the mixture is allowed to undergo a reaction at 220° C. for 7 hours. The maleic acid modification is 100.

<Rosin Diol>

(Synthesis of Rosin Dial (1))

113 parts of bisphenol A diglycidyl ether (trade name jER828, manufactured by Mitsubishi Chemical Industries) as a bifunctional epoxy compound, 200 parts of a gum rosin that has been subjected to a purification treatment by distillation (distillation conditions: 6.6 kPa and 220° C.) as a rosin component, and 0.4 part of tetraethylammonium bromide (manufactured by Tokyo Kasei Kogyo Co., Ltd.) as a reaction catalyst are put into a stainless steel reaction vessel equipped with a stirring device, a heating device, a condenser, and a thermometer, and warmed to 130° C. to carry out a ring-opening reaction between an acid group of the rosin and an epoxy group of the epoxy compound. The reaction is continuously carried out at the same temperature for 4 hours, and stopped at a point when the acid value reaches 0.5 mg KOH/g to obtain the rosin diol (1) as mentioned as the exemplary compound.

(Synthesis of Rosin Diol (2))

58 parts of ethylene glycol diglycidyl ether (trade name EX-810, manufactured by Nagase Chemtex) as a bifunctional epoxy compound, 200 parts of a disproportionated rosin (trade name Pine Crystal KR614, manufactured by Arakawa Chemical. Industries, Ltd.) as a rosin component, and 0.4 part of tetraethylammonium bromide (manufactured by Tokyo Kasei Kogyo Co., Ltd.) as a reaction catalyst are put into a stainless steel reaction vessel equipped with a stirring device, a heating device, a condenser, and a thermometer, and heated to a temperature of, 130° C. to carry out a ring-opening reaction between an acid group of the rosin and an epoxy group of the epoxy compound. The reaction is continuously carried out at the same temperature for 4 hours, and stopped at a point when the acid value reaches 0.5 mg KOH/g to obtain the rosin diol (2) mentioned as the exemplary compound.

<Specific Polyester Resin>

—Synthesis of Specific Polyester Resin 1—

300 parts of a rosin diol (1) as an alcohol component, 53 parts of terephthalic acid (manufactured by Wako Pure Chemical Industries, Ltd.) as a polyvalent carboxylic acid component, and 0.3 part of tetra-n-butyl titanate (manufactured by Tokyo Kasei Kogyo Co., Ltd.) as a reaction catalyst are put into a stainless steel reaction vessel equipped with a stirring device, a heating device, a condenser, a thermometer, a separating device, and a nitrogen gas inlet, and the mixture is subjected to a polycondensation reaction at 230° C. for 7 hours while stirring under a nitrogen atmosphere. It is confirmed that the molecular weight and the acid value reaches to each of desired values, thereby synthesizing a specific polyester resin 1.

The measurement results of the weight average molecular weight, the number average molecular weight, the glass transition temperature, and the softening temperature are shown in Table 1.

—Synthesis of Specific Polyester Resin 2—

In the same manner as for the specific polyester resin 1 except that the types and the addition amounts of the polyvalent carboxylic acid component and the polyol component are changed according to Table 1, a specific polyester resin 2 is synthesized.

The measurement results of the weight average molecular weight, the number average molecular weight, the glass transition temperature, and the softening temperature are shown in Table 1.

TABLE 1

| | | Specific polyester resin 1 For toner particles 1 | Specific polyester resin 2 For toner particles 2 |
|---|---|---|---|
| Embodiment of polycondensate | | 2) | 2) |
| Polyvalent carboxylic acid component | Terephthalic acid | 53 parts | 42 parts |
| | Docedenylsuccinic acid | — | 17 parts |
| Polyol component | Rosin diol | (1) 300 parts | (2) 250 parts |
| Mw (ten thousand) | | 1.8 | 1.5 |
| Mn (ten thousand) | | 0.4 | 0.38 |

TABLE 1-continued

| | Specific polyester resin 1 For toner particles 1 | Specific polyester resin 2 For toner particles 2 |
|---|---|---|
| Acid value(mg KOH/g) | 11.5 | 12 |
| Tg (° C.) | 65 | 60 |
| Softening point (° C.) | 129 | 120 |
| Type of rosin in rosin diol | Purified rosin | Disproportionated rosin |

—Synthesis of Specific Polyester Resins 3 to 5 and Comparative Polyester Resin 1—

In the same manner as for the specific polyester resin 1 except that the composition is changed according to Table 2, the specific polyester resins 3 to 5 and the comparative polyester resin 1 corresponding to a polycondensate of any type of 1), 3), and 4) as described above are synthesized.

The measurement results of the weight average molecular weight, the number average molecular weight, the glass transition temperature, and the softening temperature are shown in Table 2.

TABLE 2

| | | Specific polyester resin 3 For toner particles 3 | Specific polyester resin 4 For toner particles 4 | Specific polyester resin 5 For toner particles 5 | Comparative polyester resin 1 For comparative toner particles 1 |
|---|---|---|---|---|---|
| Embodiment of polycondensate | | 1) | 3) | 4) | — |
| Rosin (before modification) | Purified disproportionated rosin | — | — | 55 parts | — |
| Polyvalent carboxylic acid component | Fumaric acid-modified rosin | 150 parts | — | — | — |
| | Maleic acid-modified rosin | — | 50 parts | — | — |
| | Terephthalic acid | — | — | 35 parts | 83 parts |
| | Isophthalic acid | 15 parts | 55 parts | — | — |
| | Docedenylsuccinic acid | — | 15 parts | 30 parts | — |
| | Trimellitic acid | 3 parts | — | 10 parts | — |
| Polyol component | Rosin diol | — | (1) 14 parts | — | — |
| | 1,2-Propanediol | 12 parts | — | 13 parts | — |
| | Isosorbide | 25 parts | — | 20 parts | — |
| | 1,6-Hexanediol | 18 parts | — | — | — |
| | Cyclohexanedimethanol | — | — | — | 14 parts |
| | BPA-EO[1)] | — | — | 45 parts | 162 parts |
| | BPA-PO[2)] | — | 130 parts | — | — |
| Mw | | 18000 | 17000 | 210000 | 12000 |
| Mn | | 3100 | 3200 | 2500 | 3500 |
| Acid value (mg KOH/g) | | 15.3 | 12.4 | 18.4 | 12 |
| Tg (° C.) | | 51 | 54 | 52 | 62 |
| Softening point (° C.) | | 127 | 123 | 125 | 120 |

[1)]Bisphenol A ethylene oxide 2 mole-adduct

[2)]Bisphenol A propylene oxide 2 mole-adduct

<Toner Particles>

(Preparation of Resin Particle Dispersion 1)

100 parts by weight of the specific polyester resin 1 are put into a reactor equipped with a stirrer, dissolved, and mixed at 120° C. for 30 minutes, and then an aqueous solution for neutralization, formed by dissolving 1.0 part by weight of sodium dodecylbenzenesulfonate and 1.0 part by weight of a 1 N aqueous NaOH solution in 800 parts by weight of ion exchange water that has been heated to 95° C., is put into the flask, emulsified with a homogenizer (ULTRA TURRAX, manufactured by IKA Co., Ltd.) for 5 minutes, and then shaken in an ultrasonic wave bath for 10 minutes. Then, the flask is cooled in water at room temperature (25° C.), thereby obtaining a resin particle dispersion 1 having a median diameter of the resin particles of 250 nm and a solid content of 20% by weight.

(Preparation of Resin Particle Dispersions 2 to 5 and Comparative Resin Particle Dispersion 1)

In the same manner as for the specific polyester resin 1 except that the respective specific polyester resins 2 to 5 and comparative polyester resin 1 are used instead of the specific polyester resin 1, the resin particle dispersions 2 to 5, and the comparative resin particle dispersion 1 are prepared.

(Preparation of Comparative Resin Particle Dispersion 1)

In the same manner as for the specific polyester resin 1 except that the respective comparative polyester resin 1 is used instead of the specific polyester resin 1, the respective comparative resin particle dispersion 1 is prepared.

(Preparation of Colorant Particle Dispersion 1)

Cyan pigment (copper phthalocyanine, C. I. Pigment Blue 15:3, manufactured by Dainichiseika Color & Chemicals Mfg. Co., Ltd.): 50 parts by weight Anionic surfactant (NEOGEN R, manufactured by Daiichi Kogyo Seiyaku Co., Ltd.): 5 parts by weight Ion exchange water: 200 parts by weight The above components are mixed and dissolved, and dispersed using a homogenizer (ULTRA TURRAX, manufactured by IKA Co., Ltd.) for 5 minutes, and in an ultrasonic wave bath for 10 minutes to obtain a cyan colorant particle dispersion 1 having a median particle diameter of 190 nm and a solid content concentration of 21.5%.

(Preparation of Release Agent Particle Dispersion 1)

Anionic surfactant (NEOGEN R, manufactured by Daiichi Kogyo Seiyaku Co., Ltd.): 2 parts by weight Ion exchange water: 800 parts by weight Paraffin wax (HNP-9, manufactured by Nippon Seiro Co., Ltd.): 200 parts by weight The above components are mixed, heated to 120° C., and subjected to a dispersion treatment using a pressure ejection-type Gaulin homogenizer to obtain a 20%-by-weight release agent dispersion having a volume average particle diameter of 170 nm.

(Preparation of Toner Particles 1)

Resin particle dispersion 1: 315 parts by weight (resin 63 parts by weight)

Colorant particle dispersion 1: 40 parts by weight (pigment 8.6 parts by weight)

Release agent particle dispersion 1: 40 parts by weight (release agent 8.0 parts by weight)

Polyaluminum chloride: 0.15 part by weight

Ion exchange water: 300 parts by weight

According to the above formulation, the components are mixed and dispersed using a homogenizer (ULTRA TURRAX T50, manufactured by IKA Co., Ltd.) in a round stainless steel flask, and then the flask is heated to 42° C. under stirring in an oil bath for heating, and kept at 42° C. for 60 minutes. Then, 105 parts by weight of the resin particle dispersion 1 (21 parts by weight of the resin) is added thereto, and the mixture is stirred. Thereafter, the pH in the system is adjusted to 6.0 with a 0.5 mole/liter aqueous sodium hydroxide solution, and then heated to 95° C. under stirring. While the temperature is raised to 95° C., the pH in the system is usually decreased to a value equal to or less than 5.0, but an aqueous sodium hydroxide solution is further added dropwise thereto to maintain the pH to be not equal to or less than 5.5.

After the completion of reaction, the mixture is cooled, filtered, washed with ion exchange water, and then subjected to solid-liquid separation by a Nutsche suction filtration method. Further, the resultant is further dispersed in 3,000 parts of ion exchange water at 40° C., and stirred and washed for 15 minutes at 300 rpm. This washing operation is repeated five times, and the resultant is subjected to solid-liquid separation by a Nutsche suction filtration method. Thereafter, vacuum-drying is carried out for 12 hours to obtain toner particles. Further, the obtained toner particles 1 are taken as a toner 1.

(Preparation of Toner Particles 2 to 5 and Comparative Toner Particles 1)

The respective toner particles 2 to 5 and comparative toner particles 1 are prepared in the same manner as for the toner particles 1, except that the respective resin particle dispersions 2 to 5 and comparative resin particle dispersion 1 are used instead of the resin particle dispersion 1.

<Preparation of Toner 1>

0.5 part of silica (trade name: 8812, manufactured by Nippon Aerosil Co., Ltd.) is added to the toner particles 1 (100 parts), and mixed by a high-speed mixer to obtain a toner 1.

<Preparation of Toners 2 to 5 and Comparative Toner 1>

In the same manner as for the toner 1 except that the respective toner particles 2 to 5 and comparative toner particles 1 are used instead of the toner particles 1, the respective toners 2 to 5 and comparative toner 1 are prepared.

[Carrier]

<Coating Resin Layer>

(Solution 1 for Coating Resin Layer)

—Synthesis of Resin—

Dicyclopentanyl methacrylate: 80 parts by weight

Methyl methacrylate: 20 parts by weight

Dimethyl 2,2-azobisisobutyrate (trade name V-601: manufactured by Wako Pure Chemical Industries, Ltd.): 2 parts by weight Using the above composition, or under the following conditions, polymerization is carried out.

The monomers and reaction initiator V-601 (102 parts by weight in total) and 400 parts by weight of toluene are put into a vessel together, nitrogen is blown thereinto to carry out a reaction at 60° C. for 5 hours, thereby obtaining a polymerization resin. After the temperature is returned to room temperature (25° C.) to stop the reaction, the solution is put into methanol, and the resin is reprecipitated, filtered, and taken out. This resin is dried under vacuum to remove excess volatile components, thereby obtaining a desired resin.

—Synthesis of Solution 1 for Coating Resin Layer—

1.6 parts by weight of the resin as prepared above and the following components and glass beads (particle diameter: 1 mm, the same amount as that of toluene) are put into a sand mill (manufactured by Kansai Paint Co., Ltd.) for 30 minutes at a rotation rate of 1200 rpm to prepare a solution 1 for a coating resin layer having a solid content of 12.6%

Carbon black "VXC72 (manufactured by Cabot Corporation)": 0.12 part by weight

Toluene: 14 parts by weight

Crosslinked melamine resin particles (average particle diameter 0.3 μm, insoluble in toluene): 0.3 part by weight —Synthesis of Solutions 2 to 7 for Coating Resin Layers and Comparative Solution 1 for Coating Resin Layer—

In the same manner as for the solution 1 for a coating resin layer except that the types and the addition amounts of the composition of the resins and other components are changed according to Table 3, solutions 2 to 7 for coating resin layers and comparative solution 1 for coating resin layer are prepared.

<Preparation of Carrier>

(Carrier 1)

2000 parts by weight of ferrite particles are placed in a 5-L vacuum deairing-type kneader, and 320 parts by weight of the solution 1 for a coating resin layer is further added thereto. While stirring the mixture, the pressure is reduced to −200 mmHg at 60° C., and the mixture is mixed for 15 minutes, subjected to warming/reduction in pressure, and stirred and dried at 94° C./−720 mmHg for 30 minutes to obtain coated particles, in which ferrite particles are coated with a coating resin layer including the solution 1 for a coating resin layer.

Next, the obtained particles are classified using a 75 μm-mesh sieve to obtain a carrier 1.

(Carriers 2 to 7 and Comparative Carriers 1 to 2)

The carriers 2 to 7 and the comparative carriers 1 to 2 are prepared by coating the ferrite particles with the solutions 2 to 7 for coating resin layers, and the comparative solution 1 for a coating resin layer, prepared according to Table 3 in the same manner as for the carrier 1.

TABLE 3

| | | Solution 1 for coating resin layer (for carrier 1) | Solution 2 for coating resin layer (for carrier 2) | Solution 3 for coating resin layer (for carrier 3) | Solution 4 for coating resin layer (for carrier 4) | Solution 5 for coating resin layer (for carrier 5) |
|---|---|---|---|---|---|---|
| Acrylic resin | Dicyclopentanyl methacrylate | 0 part by weight | 90 parts by weight | 0 part by weight | 0 part by weight | 0 part by weight |
| | Isobornyl methacrylate | 0 part by weight | 0 part by weight | 0 part by weight | 0 part by weight | 0 part by weight |
| | Dicyclopentanyl acrylate | 0 part by weight | 0 part by weight | 80 parts by weight | 0 part by weight | 0 part by weight |

TABLE 3-continued

| | | | | | | |
|---|---|---|---|---|---|---|
| | Isobornyl acrylate | 0 part by weight | 0 part by weight | 0 part by weight | 0 part by weight | 0 part by weight |
| | Methyl methacrylate | 40 parts by weight | 7 parts by weight | 20 parts by weight | 18 parts by weight | 20 parts by weight |
| | Styrene | 0 part by weight | 0 part by weight | 0 part by weight | 0 part by weight | 0 part by weight |
| | Dimethyl-aminoethyl methacrylate | 0 part by weight | 3 part by weight | 0 part by weight | 2 part by weight | 0 part by weight |
| | Adamantyl methacrylate | 0 part by weight | 0 part by weight | 0 part by weight | 80 parts by weight | 0 part by weight |
| | Norbornyl acrylate | 0 part by weight | 0 part by weight | 0 part by weight | 0 part by weight | 80 parts by weight |
| | 4-Hydroxy-1-naphthyl methacrylate | 60 parts by weight | 0 part by weight | 0 part by weight | 0 part by weight | 0 part by weight |
| | Dimethyl 2,2-azobisiso-butyrate (polymerization initiator) | 2 parts by weight | 2 parts by weight | 2 parts by weight | 2 parts by weight | 2 parts by weight |
| Carbon black | | 7.7 parts by weight | 9 parts by weight | 7.7 parts by weight | 9 parts by weight | 7 parts by weight |
| Toluene | | 890 parts by weight | 900 parts by weight | 892.5 parts by weight | 900 parts by weight | 880 parts by weight |
| Crosslinked melamine resin particles (Charge control agent) | | 19.1 parts by weight | 15 parts by weight | 19.1 parts by weight | 16 parts by weight | 18 parts by weight |

| | | Solution 6 for coating resin layer (for carrier 6) | Solution 7 for coating resin layer (for carrier 7) | Comparative solution 1 for coating resin layer (for comparative carrier 1) | Comparative solution 2 for coating resin layer (for comparative carrier 2 |
|---|---|---|---|---|---|
| Acrylic resin | Dicyclopentanyl methacrylate | 0 part by weight | 0 part by weight | 40 parts by weight | 0 part by weight |
| | Isobomyl methacrylate | 70 parts by weight | 0 part by weight | 0 part by weight | 0 part by weight |
| | Dicyclopentanyl acrylate | 0 part by weight | 0 part by weight | 0 part by weight | 0 part by weight |
| | Isobornyl acrylate | 0 part by weight | 0 part by weight | 0 part by weight | 0 part by weight |
| | Methyl methacrylate | 28 parts by weight | 83 parts by weight | 58 parts by weight | 8 parts by weight |
| | Styrene | 0 part by weight | 15 parts by weight | 0 part by weight | 0 part by weight |
| | Dimethyl-aminoethyl methacrylate | 2 parts by weight | 2 parts by weight | 2 parts by weight | 2 part by weight |
| | Adamantyl methacrylate | 0 part by weight | 0 part by weight | 0 part by weight | 90 parts by weight |
| | Norbornyl acrylate | 0 part by weight | 0 part by weight | 0 part by weight | 0 part by weight |
| | 4-Hydroxy-1-naphthyl methacrylate | 0 part by weight | 0 part by weight | 0 part by weight | 0 part by weight |
| | Dimethyl 2,2-azobisiso-butyrate (polymerization initiator) | 2 parts by weight | 2 parts by weight | 2 pars by weight | 2 parts by weight |
| Carbon black | | 7 parts by weight | 7.7 parts by weight | 7.7 parts by weight | 7.7 parts by weight |
| Toluene | | 900 parts by weight | 890 parts by weight | 890 parts by weight | 890 parts by weight |
| Crosslinked melamine resin particles (Charge control agent) | | 18 parts by weight | 19.1 parts by weight | 19.1 parts by weight | 19.1 parts by weight |

Example 1

<Developer 1>

7 parts by weight of the toner 1 are added to 100 parts by weight of the carrier 1, and mixed with a tumbler-shaker mixer to obtain a developer 1.

The obtained developer 1 is evaluated as follows.

The results are shown in Table 4.

<Evaluation>

(Hardness of Coating Resin Layer/Hardness of Toner Particles)

By the method as described above, the hardness of the coating resin layer and the hardness of the toner particles are measured, and the "hardness of the coating resin layer/hardness of the toner particles" is calculated.

(Toner Charge Amount)

Image formation is carried out on 10,000 sheets using the developer 1, in a DocuCentre III 3000 manufactured by Fuji Xerox Co., Ltd. Specifically, printing with an image area of 2% is performed under a 28° C./85% RH environment.

Before carrying out the image formation and after carrying out the image formation on 10,000 sheets, 0.5 g of the developer is collected from the developing sleeve of a developing device and the charging amount is measured with a TB200, manufactured by Toshiba Chemical by a blow-off method.

(Contamination of Carrier by External Additive)

The developer on the magnetic sleeve in the developer is collected, and put into a beaker charged with an aqueous solution with 1% by weight of a nonionic surfactant, and stirred. Magnetic is contacted from the outside of the beaker, and the aqueous solution in which the toner detached from the carrier is dispersed is removed while holding the carrier. These operations are repeated, the toner is removed from the developer, and the carrier is extracted. Again, the carrier is dried and the amount of Si element derived from silica of the external additive is measured by fluorescent X-rays to evaluate the contamination of the carrier.

The evaluation criteria are as follows.

A: The proportion in % by weight of Si is less than 0.02

B: The proportion in % by weight of Si is less than 0.05 and 0.02 or more

C: The proportion in % by weight of Si is less than 0.1 and 0.05 or more

D: The proportion in % by weight of Si is 0.1 or more

Furthermore, in the evaluation criteria, B denotes the value being within an acceptable range.

(Work Function)

The work function of the specific polyester resin and the coating resin layer included in the toner particles are measured by the above-described method.

Examples 2 to 11 and Comparative Examples 1 to 2

Developers 2 to 13 are prepared in the same manner as for the developer 1 except that the types of each of the toners and the carriers are changed according to Table 4, and evaluated in the same manner as in Example 1.

The results are shown in Table 4.

TABLE 4

| | | | Hardness | | | Charge amount (μg/C) | | | | Work function (eV) | |
|---|---|---|---|---|---|---|---|---|---|---|---|
| | Toner particle | Carrier | Hardness of coating resin layer [GPa] | Hardness of toner particles [CPa] | Hardness of coating resin layer/ hardness of toner particles | Before image formation | After image formation (after image formation with 10,000 sheets) | Difference in charging amounts (Δ) | Contamination of carrier | Specific polyester resin included in toner particles | Coating resin layer of carrier |
| Example 1 | Toner particles 1 | Carrier 1 | 0.2 | 0.158 | 1.27 | 34.5 | 22.8 | 11.7 | B | 4.7 | 4.42 |
| Example 2 | Toner particles 1 | Carrier 2 | 0.31 | 0.158 | 1.96 | 40.5 | 29.8 | 10.7 | B | 4.7 | 4.33 |
| Example 3 | Toner particles 1 | Carrier 3 | 0.28 | 0.158 | 1.77 | 33.1 | 26.7 | 6.4 | A | 4.7 | 4.43 |
| Example 4 | Toner particles 1 | Carrier 4 | 0.29 | 0.158 | 1.84 | 42.4 | 35.9 | 6.5 | A | 4.7 | 4.35 |
| Example 5 | Toner particles 1 | Carrier 5 | 0.24 | 0.158 | 1.52 | 34 | 27.2 | 6.8 | A | 4.7 | 4.42 |
| Example 6 | Toner particles 1 | Carrier 6 | 0.22 | 0.158 | 1.39 | 41.6 | 30.5 | 11.1 | B | 4.7 | 4.4 |
| Example 7 | Toner particles 2 | Carrier 5 | 0.24 | 0.151 | 1.59 | 30.7 | 26.3 | 4.4 | A | 4.68 | 4.42 |
| Example 8 | Toner particles 3 | Carrier 3 | 0.28 | 0.147 | 1.90 | 38.6 | 27.1 | 11.5 | B | 4.72 | 4.43 |
| Example 9 | Toner particles 4 | Carrier 3 | 0.28 | 0.150 | 1.87 | 42.9 | 28.8 | 14.1 | B | 4.75 | 4.43 |
| Example 10 | Toner particles 5 | Carrier 3 | 0.28 | 0.145 | 1.93 | 40.1 | 27.6 | 12.5 | B | 4.73 | 4.43 |
| Example 11 | Toner particles 5 | Carrier 7 | 0.19 | 0.145 | 1.31 | 37.6 | 16.2 | 21.4 | C | 4.73 | 4.41 |
| Comparative Example 1 | Toner particles 1 | Comparative Carrier 1 | 0.18 | 0.158 | 1.14 | 40.2 | 18.7 | 21.5 | D | 4.7 | 4.38 |
| Comparative Example 2 | Toner particles 1 | Comparative Carrier 2 | 0.32 | 0.158 | 2.03 | 38.2 | 17.4 | 20.8 | D | 4.7 | 4.38 |

From the results above, it can be seen that in Examples, even after the image formation as compared with Comparative Examples, the charging amount of the toner is large, the contamination of the carrier is suppressed, and the life time of the developer is improved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

a toner for developing an electrostatic charge image, the toner containing toner particles that include a polyester resin having a rosin skeleton and an external additive, wherein a content of the rosin skeleton included in the polyester resin is from 5% by weight to 70% by weight; and a carrier having core material particles and a coating resin layer which coats a surface of the core material particles, wherein a hardness of the coating resin layer is from 1.2 times to 2.0 times that of the toner particles.

2. The electrostatic charge image developer according to claim 1, wherein the resin for the coating resin layer includes as a polymerization component at least one selected from the group consisting of dicyclopentenyl(meth)acrylate, isobornyl(meth)acrylate, adamantyl(meth)acrylate, norbornyl(meth)acrylate, and hydroxynaphthyl(meth)acrylate.

3. A process cartridge comprising:

the electrostatic charge image developer according to claim 1 accommodated in a developing unit, wherein the developing unit develops the electrostatic charge image formed on a surface of an image holding member by the electrostatic charge image developer to form a toner image, and is attached to and detached from an image forming apparatus.

4. An image forming apparatus comprising:

an image holding member;

a charging unit that charges a surface of the image holding member;

an electrostatic charge image forming unit that forms an electrostatic charge image on the surface of the image holding member;

the electrostatic charge image developer according to claim 1 accommodated in a developing unit, wherein the developing unit develops the electrostatic charge image by the electrostatic charge image developer to form a toner image;

a transfer unit that transfers the toner image onto a recording medium; and a fixing unit that fixes the toner image on the recording medium.

5. An image forming method comprising:

charging a surface of an image holding member;

forming an electrostatic charge image on the surface of the image holding member;

developing the electrostatic charge image by the electrostatic charge image developer according to claim 1 to form a toner image;

transferring the toner image onto a recording medium; and fixing the toner image on the recording medium.

* * * * *